United States Patent [19]

Furrow

[11] 4,350,451

[45] Sep. 21, 1982

[54] SLIDABLY POSITIONABLE CARTRIDGE HAVING SKEWED RIBBON FEED

[75] Inventor: Edward D. Furrow, Crimora, Va.

[73] Assignee: General Electric Company, Waynesboro, Va.

[21] Appl. No.: 121,607

[22] Filed: Feb. 14, 1980

[51] Int. Cl.[3] ..... B41J 33/14

[52] U.S. Cl. ..... 400/208; 400/213; 400/224; 400/228

[58] Field of Search ..... 400/196.1, 207, 208, 400/208.1, 213, 224, 228, 696, 697.1

[56] References Cited

U.S. PATENT DOCUMENTS

| | | | |
|---|---|---|---|
| 3,528,626 | 9/1970 | Bumb, Jr. | 400/208 X |
| 3,604,549 | 9/1971 | Caudill et al. | 400/208 |
| 3,643,778 | 2/1972 | Anderson | 400/208 |
| 3,643,779 | 2/1972 | Anderson et al. | 400/208 X |
| 3,720,954 | 3/1973 | Czyryk | 400/208 X |
| 3,731,781 | 5/1973 | Caudill et al. | 400/208 |
| 3,804,227 | 4/1974 | Cappotto et al. | 400/208 |
| 3,877,561 | 4/1975 | Guerrini et al. | 400/208 |
| 3,927,747 | 12/1975 | Wolowitz | 400/208 |
| 3,977,512 | 8/1976 | Teagarden et al. | 400/208 X |
| 3,989,132 | 11/1976 | Carson, Jr. | 400/196.1 X |
| 4,010,839 | 3/1977 | Guerrini et al. | 400/207 |
| 4,019,617 | 4/1977 | Englund et al. | 400/208 X |
| 4,034,935 | 7/1977 | Plaza et al. | 400/208 X |
| 4,047,608 | 9/1977 | Willcox | 400/208 |
| 4,209,261 | 6/1980 | Bell et al. | 400/224 X |
| 4,247,210 | 1/1981 | Kacmarcik et al. | 400/697.1 |

FOREIGN PATENT DOCUMENTS

| | | | |
|---|---|---|---|
| 2329446 | 5/1977 | France | 400/697.1 |

*Primary Examiner*—Ernest T. Wright, Jr.
*Attorney, Agent, or Firm*—Michael Masnik

[57] ABSTRACT

An inked ribbon winding device and an inked ribbon cartridge for use in a printing apparatus. A dispensing and a takeup spool, located closely together and at different elevations in the cartridge, establish a skewed angle of the ribbon traversing the exterior of the cartridge. The ribbon wound about the takeup spool engages a rotatable member fixedly rotatably mounted on a support structure for rotating the takeup spool and drawing the ribbon across a printing position at a substantially constant average rate of movement. The cartridge is longitudinally slidably mounted on the support structure and is urged toward the rotatable member by a biasing means.

25 Claims, 8 Drawing Figures

FIG. 3
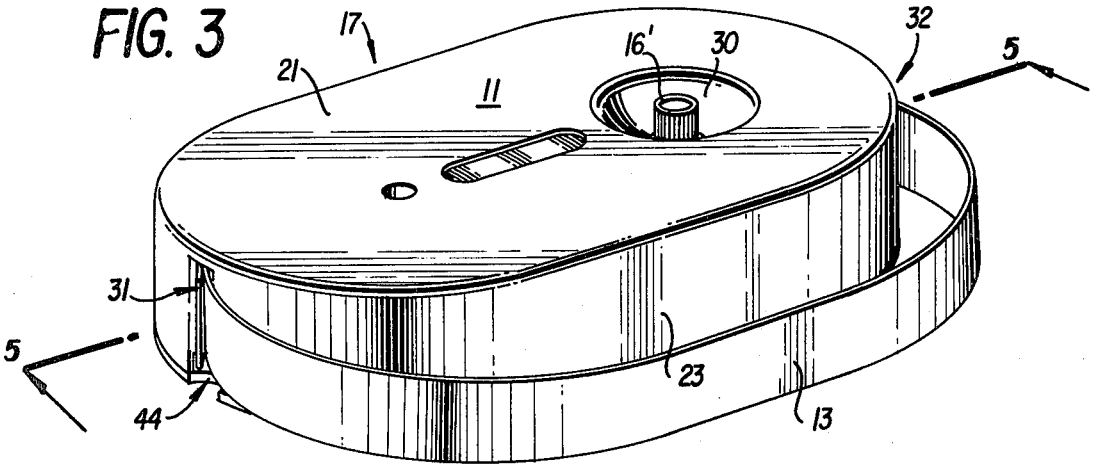
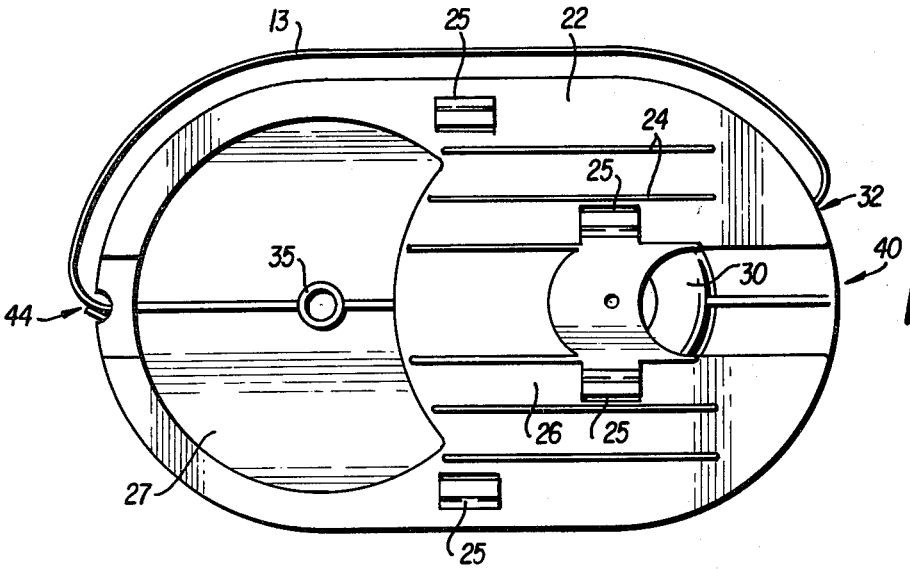
FIG. 4
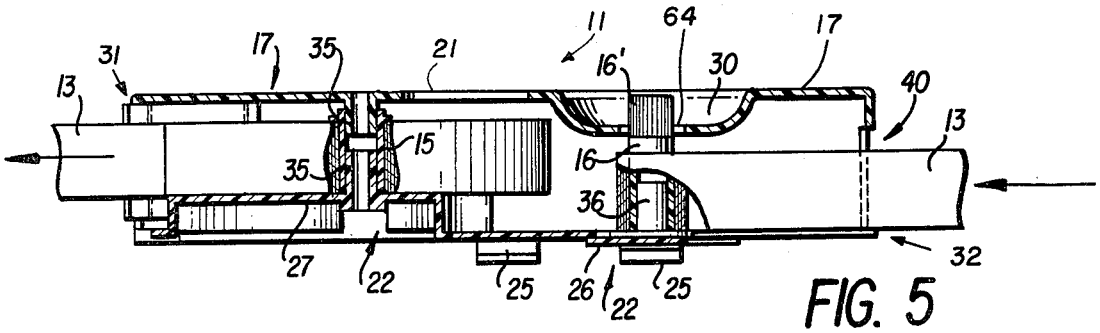
FIG. 5

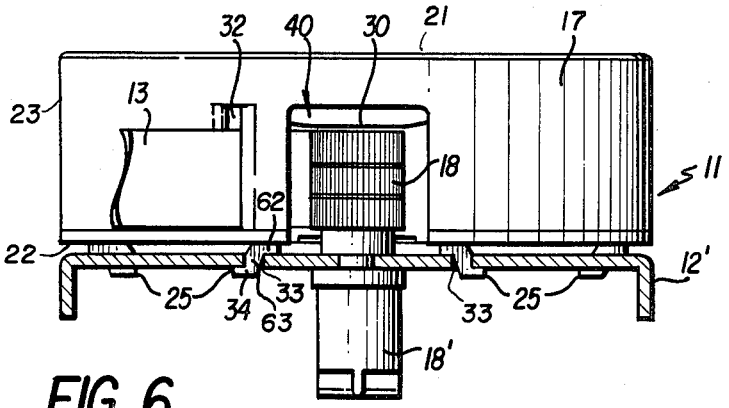
FIG. 6
FIG. 7
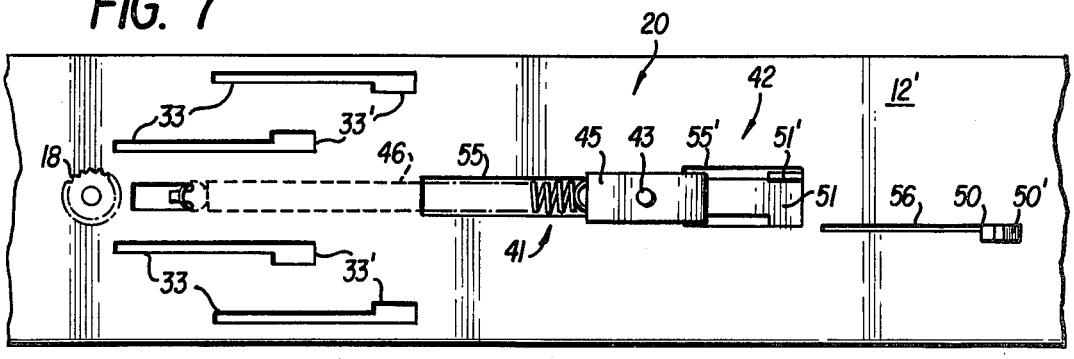
FIG. 8
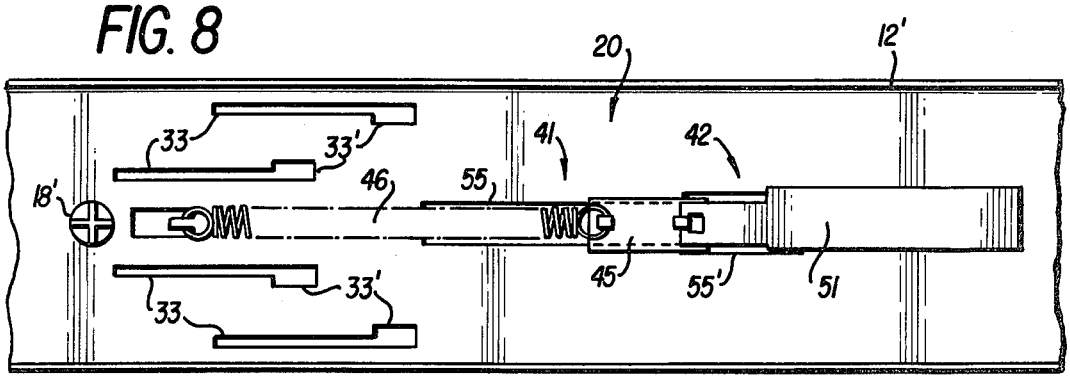

SLIDABLY POSITIONABLE CARTRIDGE HAVING SKEWED RIBBON FEED

BACKGROUND OF THE INVENTION

This invention relates to a new and improved inked ribbon winding device for a printing apparatus including a new and improved inked ribbon cartridge for a printing apparatus.

The prior art includes various kinds of devices for dispensing and winding inked ribbon during printing operations. Some such devices employ ribbon cartridges to dispense inked ribbon to a printing position, and to rewind the ribbon on a takeup spool after printing. The ribbon is drawn across the printing position by directly or indirectly driving the takeup spool.

In direct drive devices, a takeup spool spindle is directly driven. In indirectly driven devices, a rotatable member engages and drives the surface of the ribbon being wound about the takeup spool. In the latter type of device, the rotatable member is usually movable to account for ribbon accumulation on the takeup spool. In both cases, a complicated mechanism is generally required to drive the takeup spool.

Additionally, in the operation of a printing apparatus it is generally desirable to feed the ribbon to the printing position at a relatively constant rate. Accordingly, the outer circumference of the ribbon being wound at the takeup spool has to move at a relatively constant speed. However, the circumference of the roll of ribbon being wound about the takeup spool continually increases during printing operation. As a result, if the rotatable member axially drives the takeup spool mounted thereon at a constant rate, the speed of the ribbon moving across the printing position continually increases. A mechanism in the winding device for diminishing the angular velocity of the rotatable member is accordingly required in such a winding device.

When the takeup spool is rotated through engagement between the rotatable member and the ribbon wound about the takeup spool, the rate of movement of the ribbon is generally uniform. However, to insure this uniform rate of movement, means must be provided to maintain an effective non-slipping, mechanical engagement force between the rotatable member and the ribbon on the takeup spool. Each of the abovediscussed drives can require a complicated arrangement of parts including gears, links, levers, cams and ratchet wheels.

Accordingly, a primary object of the present invention is to provide a new and improved printing apparatus including a new and improved inked ribbon winding device.

Another object of the present invention is to provide a new and improved inked ribbon cartridge for use in a printing apparatus.

Another object of the present invention is to provide a new and improved inked ribbon winding device having an inked ribbon cartridge for use in a printing apparatus and driven by a rotatable member rotating on a fixed axis in a support structure and driving a ribbon takeup spool through engagement with ribbon wound thereon.

Another object of the present invention is to provide a new and improved inked ribbon winding device having an inked ribbon cartridge which is slidably mounted on a baseplate to effect engagement between a rotatable drive member and ribbon wound on a takeup spool in the cartridge and to provide automatic movement of the cartridge to compensate for increases in the radius of the ribbon roll being wound on the takeup spool.

Another object of the present invention is to provide a new and improved inked ribbon cartridge wherein its dispensing and takeup spools are closely situated in an arrangement effective to reduce cartridge size and materials.

Another object of the present invention is to provide a new and improved inked ribbon winding device which feeds ribbon to a printing position along a preferred path.

Still another object of the present invention is to provide a new and improved inked ribbon winding device which biases a cartridge containing inked ribbon into engagement with a rotatable member whereby the winding mechanism can be simple and reliable.

SUMMARY OF THE INVENTION

The inked ribbon winding device of this invention dispenses inked ribbon from a disposable cartridge which is slidably mounted on a support structure. The ribbon is held on a dispensing spool within the cartridge prior to printing and is transferred to a takeup spool after passing a printing position external of the cartridge. The cartridge is slidably positionable over a rotatable drive member which, during printing operation, operatively engages and winds the ribbon by indirectly rotating the takeup spool. The rotatable member rotates about a fixed axis extending perpendicular to the surface of the support structure and parallel to the axis of the takeup spool.

Operative engagement between the ribbon on the takeup spool and the rotatable member is insured by a biasing means urging the cartridge towards, and ribbon on the takeup spool mounted therein against, the rotatable member. The force exerted by the biasing means is releasable to enable the mounting on and removal of the cartridge from the support structure of the printing apparatus.

In one embodiment of the invention where size is a limitation, the dispensing spool is mounted in the cartridge on a higher level than the takeup spool and the spools are spaced apart at a distance no greater than the diameter of a spool fully wound with ribbon. Thusly, the inked ribbon is provided to the printing position on a skewed path, affording more economical consumption of inked ribbon during printing.

BRIEF DESCRIPTION OF THE DRAWING

The invention will be better understood from the following description taken in conjunction with the accompanying drawing, wherein:

FIG. 3 is a perspective view of the inked ribbon cartridge showing a section of ribbon traversing the distance between two sidewall apertures.

FIG. 4 is a view of the inked ribbon cartridge showing the underside of a platform for a dispensing spool, mounting lugs for enabling slidable support of the cartridge, and the entry aperture for a drive member.

FIG. 5 is a vertical cross-section taken along the longitudinal axis of the inked ribbon cartridge taken along line 5—5 of FIG. 3.

FIG. 6 is a cross-sectional view of the support structure baseplate taken along the line 6—6 of FIG. 1, looking in the direction of the arrows and illustrating the manner in which the lugs retain the cartridge on the panel and the drive member engages the ribbon on the takeup spool.

FIG. 7 is a fragmentary top view of the baseplate without a cartridge mounted thereon.

FIG. 8 is a fragmentary view of the baseplate as viewed from below and without a cartridge mounted thereon.

DESCRIPTION OF THE PREFERRED EMBODIMENT

Figure 1:
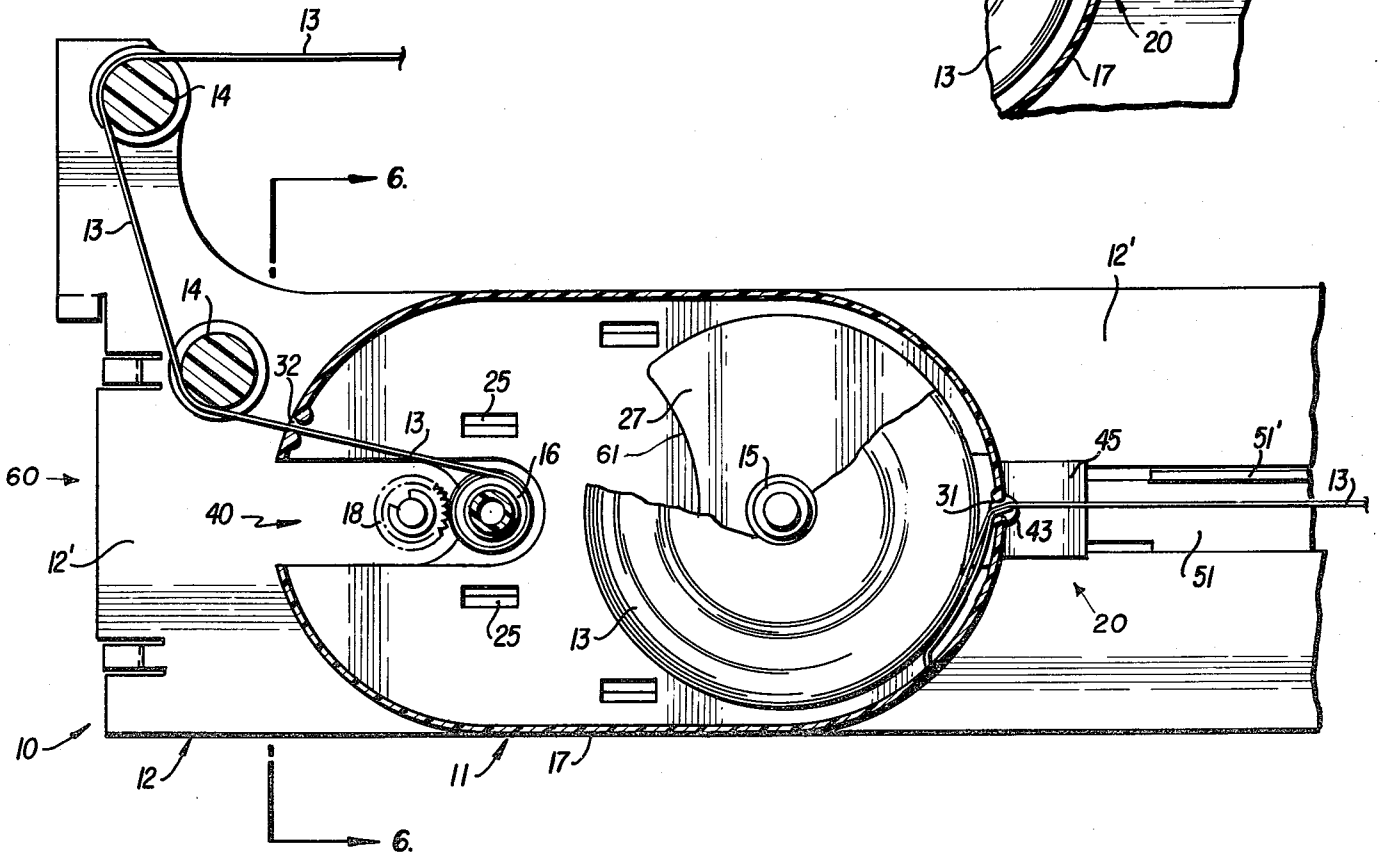
FIG. 1 is a top view of an inked ribbon cartridge and its support structure, wherein the top of the cartridge is broken away to show a rotatable drive member in operative engagement with ribbon wound on a takeup spool, and wherein a cartridge biasing arrangement is illustrated.

Turning now to a consideration of the drawing, and in particular FIG. 1, there is shown an inked ribbon winding device 10 having a cartridge 11 mounted on a support structure 12 including a baseplate 12'. The inked ribbon winding device 10 supplies inked ribbon 13 to a printing position (not shown) by a plurality of guiding spools, generally designated 14. The ribbon 13 is wound about a dispensing spool 15 in the cartridge 11 for delivery to the printing position and is attached for rewinding to a takeup spool 16. Both spools 15, 16 are rotatably mounted in a housing 17 of the cartridge 11.

FIG. 1 further shows a rotatable drive member 18 engaging the ribbon 13 on the takeup spool 16 and winding it about the takeup spool 16. Additionally, a biasing means generally indicated at 20 urges the cartridge 11 toward the rotatable drive member 18 to insure operative engagement between the rotatable drive member 18 and the ribbon 13 wound on the takeup spool 16.

The ribbon 13 may be of any commercially available kind, be it cloth, plastic, or another material impregnated with or capable of bearing ink. During printing, the ribbon 13 is desirably drawn across the printing position at a substantially constant average rate of speed.

The housing 17 is formed of molded plastic, and as shown in FIG. 3 is generally oval. Additionally, the housing 17 has a topwall 21, a bottomwall 22 seen in FIG. 4, and a sidewall 23. The bottomwall 22 has ribs 24 for structural support and lugs 25 for holding the cartridge 11 onto the support structure 12 further described below. As seen in FIGS. 4 and 5, the bottomwall 22 comprises a lower section 26 and a raised section or platform 27 disposed above the level of the lower section 26. The topwall 21 has an annular depression 30 which, in the embodiment shown, is approximately equal in depth to the elevation of the platform 27 above the lower section 26 of the bottomwall 22. The sidewall 23 includes a pair of spaced vertical apertures or slots 31, 32, each on an opposite side of the cartridge 11. The ribbon 13 departs from one slot 31 near the dispensing spool 15 and re-enters the cartridge 11 at the other slot 32 near the takeup spool 16.

As best seen in FIG. 6, each lug 25 includes a shoulder 62 to support the weight of the cartridge 11 when resting on the baseplate 12', an arm 63 which extends through a keyslot 33 in the body of the baseplate 12', and a hand 34 to engage the underside of the baseplate 12' for retaining the cartridge 11 in slidable relation thereon.

In this embodiment, and as seen in FIG. 5, the dispensing spool 15 is rotatably mounted on opposed spindles 35 formed off the topwall 21 and the platform 27 of the housing 17. The dispensing spool 15 rotates freely thereabout. The takeup spool 16 is similarly rotatably mounted on another spindle 36 formed off the bottomwall 22 of the housing 17.

As seen in FIG. 5, a level difference is provided between the platform 27 on which the dispensing spool 15 is mounted and the lower level 26 on which the takeup spool 16 is mounted. This causes the ribbon 13 to traverse a skewed path external to the cartridge 11 between the first and the second spaced slots 31, 32. As is well known in the art, a skewed path of ribbon 13 across a printing position allows the maximum utilization of ribbon surface during printing operation and simplifies the operation of a printer 60.

The axes of the two spools 15, 16 are substantially parallel and, in this embodiment, are separated by a distance of no more than the diameter of either spool 15 or 16 fully wound with ribbon 13. Spacing the spools 15 and 16 closely together conserves space and reduces the overall length of the cartridge 11 as well as the amount of plastic material required to form the cartridge 11.

The platform 27 supporting the dispensing spool 15 is generally circular, as shown from above in FIG. 1 and from below in FIG. 4. The platform 27 provides a support for the dispensing spool 15 and the ribbon 13 wound thereabout, especially in the early stages of printing operation (which is shown in FIG. 1). At that point most of the ribbon 13 is wound about the dispensing spool 15 and very little of it is wound about the takeup spool 16. The platform 27 also has a recessed section 61 to accommodate the fully wound state of the takeup spool 16 in the later stages of winding. In other words, the platform 27 does not extend into the region within the projected image of the fully wound takeup spool 16.

As shown in FIG. 7, the baseplate 12', which is provided to support the cartridge 11, includes keyslots 33 for cooperatively receiving lugs 25 of the cartridge 11 for slidably mounting the cartridge 11 on the baseplate 12'. Each keyslot 33 includes an enlargement 33' on the side furthest removed from the rotatable drive member 18. These enlargements 33' permit the vertical insertion of the lugs 25 into the baseplate 12', and the longitudinal positioning of the cartridge 11 on the baseplate 12' in order to put the ribbon 13 wound on the takeup spool 16 into operative engageent with the rotatable drive member 18. The keyslots 33 are aligned with the longitudinal axis of the baseplate 12' to permit the sliding movement of the cartridge 11 longitudinally toward the rotatable drive member 18.

The rotatable drive member 18 is mounted on the baseplate 12' of printer 60 to rotate about an axis perpendicular to the plane of the baseplate 12'. It is driven and powered by external means (such as a motor) carried by the printer 60 and located below the baseplate 12' and controlled by suitable controls such as a switch. A portion 18' (FIG. 6) of the rotatable drive member 18 extends through the baseplate 12'. The rotatable drive member 18 indirectly drives the takeup spool 16 by directly engaging the ribbon 13 under suitable pressure.

As seen in FIG. 1, the cartridge housing 17 in this embodiment further includes an elongated aperture or slot 40 which extends along the longitudinal axis of the housing 17 and contiguously through the sidewall 23 and the bottomwall 22 thereof. Additionally, it extends from a point at the base of the takeup spool 16 to the sidewall 23. The height of the aperture 40 in the sidewall 23 is large enough to allow the cartridge housing 17 to admit the rotatable drive member 18 when the cartridge 11 is longitudinally urged toward the rotatable drive member 18.

Figure 2:
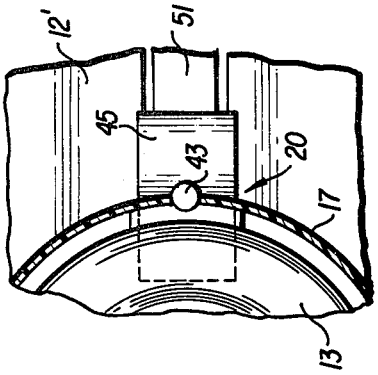
FIG. 2 is an enlarged fragmentary sectional view of one end of the inked ribbon cartridge, illustrating the cooperative engagement between the biasing means and the cartridge.

The biasing means 20 includes a spring means 41 and a release means 42. The spring means 41 comprises an urging member or stud 43 for engaging the side of the cartridge 11 as in FIG. 2 at a location longitudinally opposite of the aperture 40 and preferably in a notch 44 near the axis of the housing 17 and seen in FIG. 3. The spring means 41 further comprises a spring plate 45 which carries the stud 43. A spring 46 is suitably attached at one end to the underside of the baseplate 12' and at the other end to the spring plate 45, in order to bias the spring plate 45 and to direct the stud 43 into the notch 44 for urging the cartridge 11 toward the rotatable drive member 18. The biasing means 20 thereby urges the ribbon 13 on the takeup spool 16 to operatively engage the rotatable drive member 18.

The release means 42 is shown in fully extended position in FIG. 7 and FIG. 8 and is suitably attached to the spring plate 45 beneath the baseplate 12'. The release means 42 includes a release finger 50 and an extension plate 51 suitably connected to the spring plate 45. The extension plate 51 travels under the influence of the spring 46 along the longitudinal axis of the baseplate 12' in union with the spring plate 45 during printing operation. The release means 42 fully extends the spring 46 and withdraws the stud 43 from the cartridge 11 on the baseplate 12' with the lugs 25 entering respective keyslot openings without interference. Withdrawing the stud 43 by pulling the release means 42 further to the right in FIG. 7 permits the manual removal of the cartridge 11 from the baseplate 12'.

The spring means 41 and the release means 42 are cooperatively slidably mounted in first and second longitudinal slots 55, 56 in the baseplate 12'. The first slot 55 is sufficiently long to permit the cartridge 11 to be positioned in the keyslots 33 without interference from the stud 43. The first slot 55 is also at least long enough to allow the stud 43 to urge the takeup spool 16 into indirect engagement with the rotatable drive member 18. Additionally, the first slot 55 has a broad end 55' wide enough to allow the spring plate 45 to be positioned in the plane of the baseplate 12' without touching the sides of the slot 55.

The second slot 56 is sufficiently long to allow the spring means 41 complete freedom of movement along the first slot 55 when the finger extension plate 51 is connected to move in coordination with the spring plate 45.

Although other arrangements for slidably mounting the spring plate 45 on the baseplate 12' will occur to persons skilled in the art, the spring plate 45 in this embodiment is mounted by first positioning it on the broad end 55' of the first slot 55 and then translating it longitudinally in position to slide along tracks formed on the edges of the narrow end of the first slot 55 to receive the suitably accommodating edges of the spring plate 45.

To mount the release means 42 on the baseplate 12', the extension plate 51 is suitably connected to the spring plate 45 and the release finger 50 is extended through the second slot 56 from below the baseplate 12'. A knob 50' is then clamped onto the head of the release finger 50 to prevent its downward withdrawal. The extension plate 51 is thereby held onto the baseplate 12' by connection to the spring plate 45 and the holding action of the knob 50' on the release finger 50. The extension plate 51, moreover, is held in spaced relationship to the underside of the baseplate 12' by a turned-down flange 51' which slidably abuts the baseplate 12'.

To mount the cartridge 11 in the printing apparatus, a length of ribbon 13 is manually withdrawn from the cartridge 11 by unwinding a number of turns from the dispensing spool 15. The ribbon 13 is suitably positioned on the guiding spools 14 and on the printing position (not shown). Slack in the ribbon 13 may be removed by turning a knurled knob 16', seen in FIGS. 3 and 5, at the end of the takeup spool 16 and extending through a hole 64 in the bottom of the annular depression 30.

To mount the cartridge 11 on the baseplate 12', one retracts the biasing means 20 and the stud 43 by manually pulling the release finger 50 in a direction opposite the rotatable drive member 18. This provides clearance for positioning the cartridge 11 over the enlargements 33' of the keyslots 33 corresponding to the lugs 25 on the bottomwall 22 of the cartridge 11. The cartridge 11 is then placed on the baseplate 12' with the lugs 25 entering their respective enlargements 33'. When the shoulders 62 of the lugs 25 rest on the baseplate 12' with the remaining portions of the lugs 25 extending therethrough, the position of the cartridge 11 is longitudinally or laterally translated along the axis of the baseplate 12' toward the rotatable drive member 18 until the ribbon 13 around the takeup spool 16 engages the rotatable drive member 18. At this point the cartridge 11 is effectively latched into place, resisting all vertical movement. The biasing means 20 is then released toward its former position, and the stud 43 of this embodiment engages the cartridge 11 in its notch 44, insuring operational engagement between the ribbon 13 on the takeup spool 13, and rotatable drive member 18.

In printing operation, the inked ribbon winding device provides ribbon 13 to a printing position (not shown) at a constant average velocity. The takeup spool 16 winds ribbon 13 from the printing position and simultaneously unwinds the dispensing spool 15 by exerting tension on the ribbon 13 traveling over the guiding spools 14 guiding the ribbon 13 from the cartridge 11 to the printing position and back again. As the takeup spool 16 continues to wind ribbon 13, the accumulated thickness of the ribbon 13 about the takeup spool 16 creates a longitudinally directed pressure between the takeup spool 16 and the rotatable drive member 18. The rotatable drive member 18 is anchored in place, turning about an axis perpendicular to the plane of the baseplate 12'. As a result, the entire force exerted between the takeup spool 16 and the rotatable drive member 18 is applied longitudinally against the cartridge 11 and transmitted to the biasing means 20, causing the cartridge 11 to slide away from the rotatable drive member 18 on the lugs 25 along the longitudinal axis of the baseplate 12'. Accordingly, the lugs 25 slide along the keyslots 33 in the baseplate 12' and toward the enlargements 33' in their respective keyslots 33. Once the ribbon 13 has completed its winding about the takeup spool 16 during printing, the lugs 25 are situated near the threshold of the enlargements 33' in anticipation of removal of the cartridge 11.

To remove the cartridge 11 from the support structure 12, the mounting operation is essentially reversed.

The biasing means 20 is again withdrawn by pulling the release finger 50 away from the cartridge 11. The cartridge 11 is longitudinally positioned with the lugs 25 directly in the keyslot enlargements 33'. The cartridge 11 is then removed from the support structure 12 and the ribbon 13 hanging therefrom is suitably freed from the guiding spools 14 and from the printing position. The biasing means 20 is again released and removal is finished.

After reference to the foregoing, modifications of this invention may occur to those skilled in the art. However, it is to be understood that this invention is not intended to be limited to the particular embodiment shown and described herein but is intended to cover all modifications coming within the spirit and scope of the invention as claimed.

What I claim as new and desire to secure by Letters Patent of the United States is:

1. An inked ribbon supply arrangement for a printing apparatus comprising:

a ribbon cartridge, said cartridge comprising a housing;

a ribbon dispensing spool and a ribbon takeup spool rotatably supported in said housing on spaced axes;

an inked ribbon wound on said dispensing spool, exiting said housing at one location and re-entering said housing at a second location, and having an end attached for winding on said takeup spool;

a rotatable member extending into said cartridge housing through an aperture at a third location in driving engagement with said ribbon on said takeup spool for rotating said takeup spool thereby to wind said ribbon thereon; and means for moving said cartridge longitudinally as a function of the diameter of inked ribbon being wound up on said takeup spool.

2. An inked ribbon winding device for a printing apparatus comprising:

a ribbon cartridge comprising:

a housing having a sidewall including a spaced pair of apertures, and a bottomwall having an aperture;

a ribbon dispensing spool and a ribbon takeup spool rotatably supported in said housing on spaced axes;

an inked ribbon wound on said dispensing spool, exiting said housing from one of said spaced pair of apertures and re-entering said housing through the other of said spaced pair of apertures, and having an end attached for winding on said takeup spool;

a rotatable member extending into said cartridge housing through said aperture in the bottomwall thereof for directly engaging said ribbon on said takeup spool under sufficient pressure to rotate said takeup spool thereby to wind said ribbon thereon;

means located fixedly and externally of said housing for rotatably mounting and driving said rotatable member;

said rotatable member being fixedly mounted in a support structure, said ribbon cartridge being slidably mounted on said support structure, and said bottomwall aperture of said cartridge housing including an elongated slot enabling said cartridge to be moved relative to said rotatable member by forces resulting from the accumulation of ribbon on said takeup spool.

3. The invention of claim 2, wherein said cartridge is biased to maintain the ribbon wound on said takeup spool in operative driven engagement with said rotatable member.

4. The invention as in claim 3, wherein said cartridge is biased by spring means including a stud slidably mounted in said support structure to engage the side of said cartridge opposite the rotatable member, whereby said ribbon wound on said takeup spool is maintained in operative driven engagement with said rotatable member.

5. The invention of claim 4, wherein the cartridge includes a notch for receiving said stud.

6. The invention of claim 2, wherein the axes of said dispensing and takeup spools are substantially parallel and the distance therebetween is less than the diameter of said dispensing spool fully wound with said ribbon.

7. The invention of claim 2, wherein said ribbon exits said cartridge housing at an elevation spaced from the level at which said ribbon re-enters said housing for winding on said takeup spool, whereby said ribbon is caused to traverse a skewed path between said spaced pair of apertures in said sidewall of said housing.

8. The invention of claim 2, wherein said elongated slot in the bottomwall of said cartridge housing extends outwardly adjacent the base of said takeup spool and along a radius coincident with the direction of slidability of said cartridge.

9. The invention of claim 2, wherein said sidewall of said cartridge housing includes an elongated slot contiguous with said elongated slot in the bottomwall thereof to permit said cartridge to be moved into and out of a position wherein said rotatable member and the ribbon wound on said takeup spool are in operative engagement.

10. The invention of claim 2, wherein said axes of said ribbon dispensing and takeup spools are parallel and wherein said rotatable member rotates on a fixed axis spaced from and parallel to the axes of said spools.

11. The invention of claim 8, further comprising means for guiding said ribbon between said spaced apertures to bring said ribbon to a printing location.

12. The invention of claim 11, wherein said means for guiding includes a plurality of guiding spools.

13. The invention of claim 2, wherein said support structure includes a baseplate having a plurality of keyslots straddling the longitudinal axis thereof, each of said keyslots includes an enlargement and said cartridge includes a plurality of lugs insertable into said respective enlargements of said keyslots and translatable along the length of said keyslots.

14. The invention of claim 13, wherein said support structure comprises a biasing means on said baseplate for applying a longitudinally directed force against said cartridge to urge said takeup spool toward said rotatable member.

15. The invention of claim 14, wherein said biasing means comprises a release finger protruding through a longitudinal slot in said baseplate, whereby said biasing means may be manually withdrawn from applying force against said cartridge for enabling removal of said plurality of lugs from said keyslots and said respective enlargements.

16. An inked ribbon cartridge for a printing apparatus comprising:

(a) a housing having a sidewall and top and bottom walls;

(b) a ribbon dispensing spool and a ribbon takeup spool rotatably supported on spaced axes in said housing between said top and bottom walls;

(c) an inked ribbon wound on said dispensing spool, exiting said housing from an aperture in said sidewall, reentering said housing through another aperture in said sidewall thereof, and having an end attached for winding on said takeup spool; and (d) said bottom wall having an elongated slot positioned adjacent the portion of the takeup spool where the ribbon is wound thereon for admitting a rotatable member to directly engage said ribbon wound on said takeup spool under sufficient pressure to drive said takeup spool through engagement with said inked ribbon wound thereon, and biasing means for moving said cartridge as a function of the diameter of the inked ribbon being wound on said takeup spool.

17. The invention of claim 16, wherein said housing includes a notch longitudinally opposite said elongated slot to receive said biasing means urging said cartridge toward said rotatable member, whereby said inked ribbon wound about said takeup spool is urged into operative engagement with said rotatable member.

18. The invention to claim 16, wherein said bottom wall of the housing includes lugs for detachably and slidably mounting the cartridge on a supporting structure.

19. The invention of claim 16, wherein the axes of said dispensing and takeup spools are substantially parallel and the distance therebetween is less than the diameter of said dispensing spool fully wound with said ribbon.

20. The invention of claim 19, wherein said inked ribbon exits said housing at an elevation vertically spaced from the level at which said inked ribbon reenters said housing for winding on said takeup spool, whereby said ribbon traverses a skewed path between said ribbon exiting and re-entering apertures.

21. The invention of claim 20, wherein the cartridge further comprises an internal platform on which said dispensing spool is rotatably mounted, and said takeup spool is mounted on said bottom wall to provide a difference in elevations of ribbon on said spools.

22. The invention of claim 16, wherein said elongated slot extends outwardly along a radius from a point adjacent the base of said takeup spool.

23. The invention of claim 22, wherein said elongated slot extends into said sidewall, whereby said elongated slot permits the lateral admission of said rotatable member to drive said takeup spool.

24. The invention of claim 16, further comprising a knob on said takeup spool extending through an opening in an annular depression in said top wall to permit manual rotation of said takeup spool.

25. In a printer having a rotatable ribbon drive member supported at a fixed location on said printer, a disposable ribbon cartridge comprising:

a housing rotatably supporting a ribbon dispensing spool and a ribbon takeup spool separated from one another on respective axes;

means for driving ribbon from said dispensing to said takeup spool comprising means for engaging ribbon being wound on said takeup spool with said drive member comprising an opening in said housing along a given axis for receiving the drive member, biasing means providing a biasing force having a component along said given axis for maintaining the ribbon being wound on said takeup spool in continuous operative engagement with said drive member during windup of ribbon on the takeup spool, said cartridge responsive to increasing diameter of ribbon being wound on said takeup spool in engagement with said fixedly supported drive member to move along said given axis.

* * * * *